United States Patent [19]

Cashdollar, Sr.

[11] 4,078,600

[45] Mar. 14, 1978

[54] CONTINUOUS CASTING

[76] Inventor: Robert E. Cashdollar, Sr., 890 New Castle Rd., Butler, Pa. 16001

[21] Appl. No.: 654,867

[22] Filed: Feb. 3, 1976

[51] Int. Cl.[2] ..... B22D 11/00

[52] U.S. Cl. ..... 164/418; 164/73; 164/437

[58] Field of Search ..... 164/273, 281, 64, 66, 164/73, 82, 83, 274, 418, 437; 239/299, 601

[56] References Cited

U.S. PATENT DOCUMENTS

| | | | |
|---|---|---|---|
| 2,187,720 | 1/1940 | Williams | 164/64 |
| 2,206,888 | 7/1940 | Greenidge | 164/73 |
| 3,528,484 | 9/1970 | Scharf et al. | 164/273 R |
| 3,572,422 | 3/1971 | Lyman | 164/273 R |
| 3,780,789 | 12/1973 | Unger | 164/283 R |

FOREIGN PATENT DOCUMENTS

| | | | |
|---|---|---|---|
| 1,069,045 | 7/1954 | France | 164/273 |
| 426,439 | 6/1967 | Switzerland | 164/273 |
| 348,281 | 9/1972 | U.S.S.R. | 249/174 |

*Primary Examiner*—Francis S. Husar

*Assistant Examiner*—Gus T. Hampilos

*Attorney, Agent, or Firm*—Hymen Diamond

[57] ABSTRACT

A continuous-casting apparatus in which the cover over the mold has an opening whose boundaries or inner edges are rounded and whose corners are rounded. The walls bounding the opening in the cover overlie and mate, as precisely as practicable, with the walls bounding the opening in the mold through which the molten metal flows. In addition, the surfaces of the walls which bound the opening of the cover and the adjacent surfaces of the cover have a fine finish and are coated with friction reducing and molten-metal adhesion-reducing material. The mating of the portions of the walls, the rounded inner edges and corners and the coating suppresses adhesion of spattered molten metal to the walls of the cover. The rounding of the corners formed by the walls which bound the opening in the cover provides a generally triangular channel, between the walls which bound the opening in the cover and the corners formed by the walls bounding the opening in the mold, through which lubricant flows to the walls bounding the mold.

3 Claims, 10 Drawing Figures

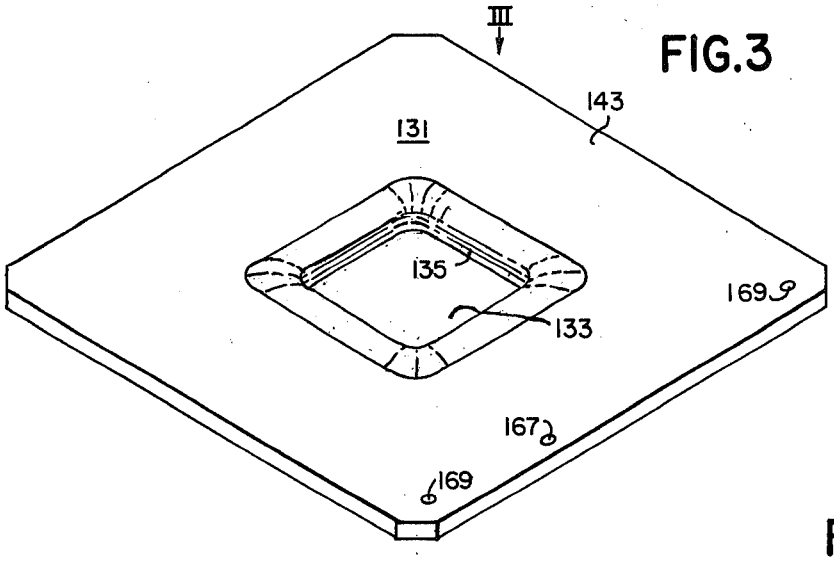
FIG.3
FIG.4
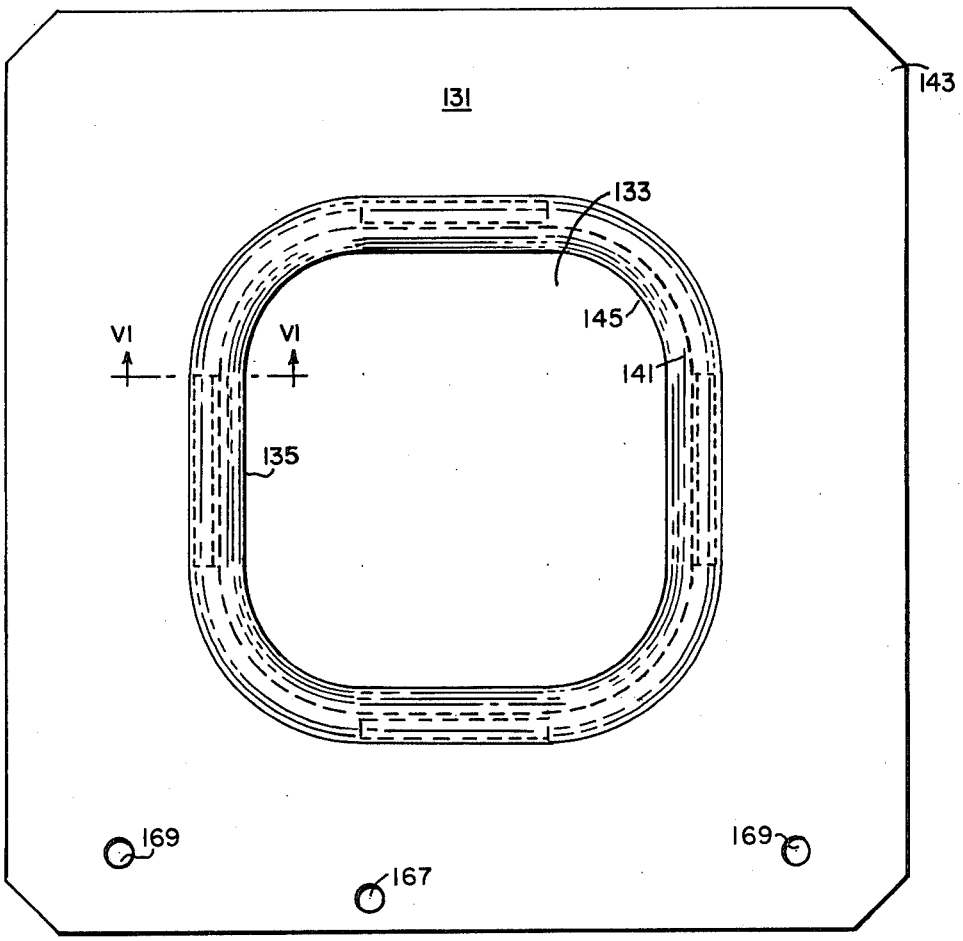
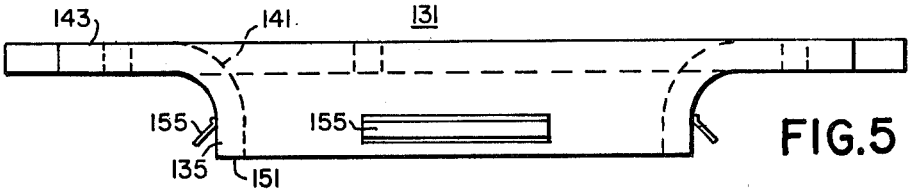
FIG.5

FIG. 4a
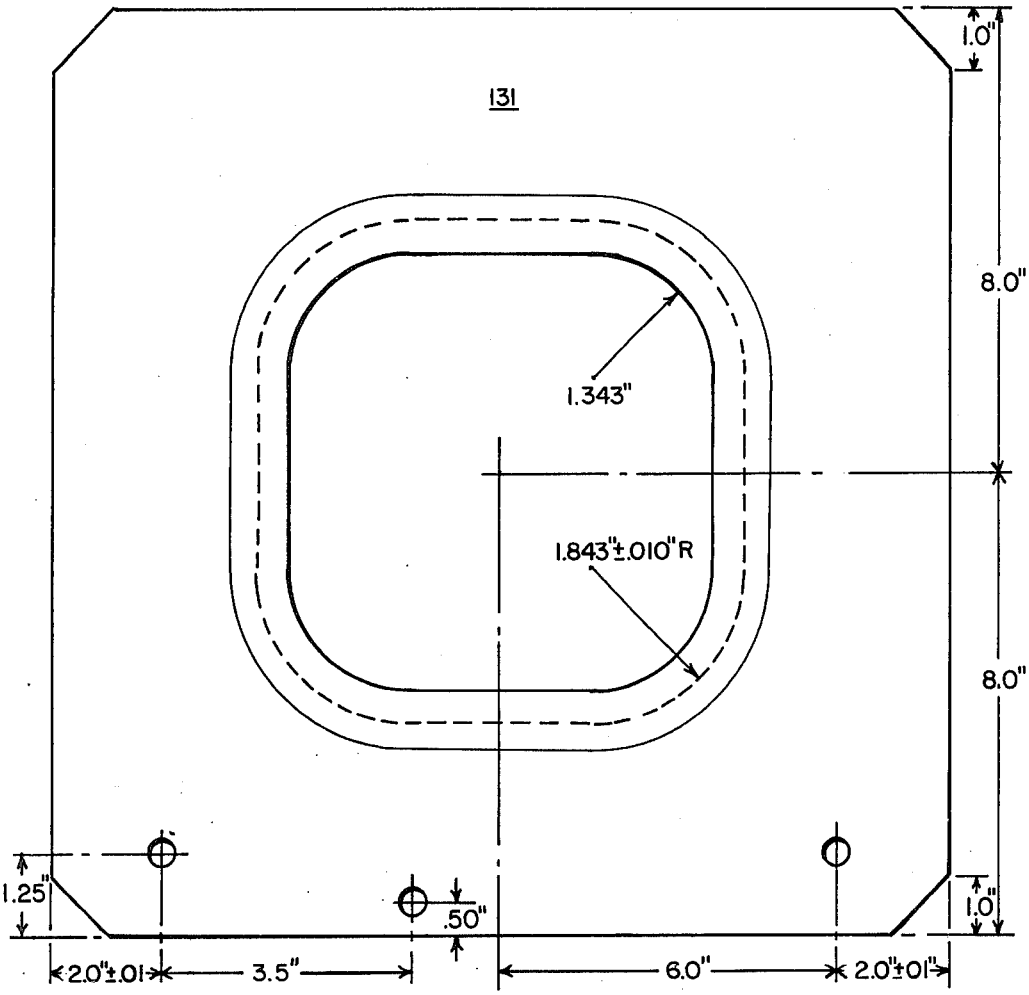
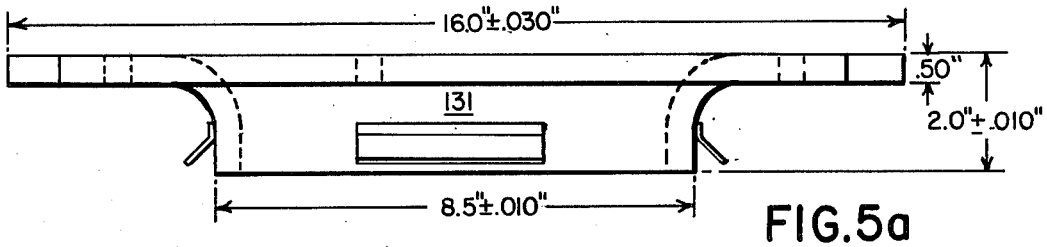
FIG. 5a
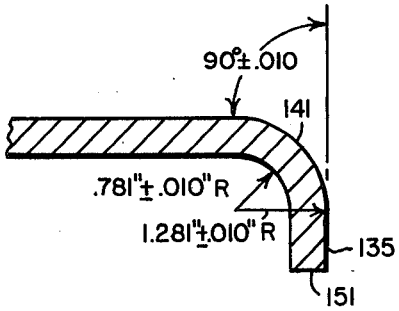
FIG. 6

CONTINUOUS CASTING

BACKGROUND OF THE INVENTION

This invention relates to steel making and has particular relationship to continuous casting. In continuous casting each of one or more streams of molten metal flow into a chill mold having a cavity where the metal solidifies. The metal solidifies about a starter stool which advances the solidified mass and the strip attached to it to pinch rolls that advance the strip to the cutting shears. Typical continuous-casting apparatus is shown in Cashdollar U.S. Pat. No. 3,754,590.

The mold is a water-cooled structure of substantial cost. The walls bounding the opening in the mold through which the molten metal flows have holes for injecting lubricant to lubricate the walls of the opening and the mold cavity. If no protective cover were interposed between the walls of the opening in the mold and the stream of molten metal, molten metal would in a short time adhere to the walls of the mold damaging the mold beyond repair or demanding time-consuming and costly operations by a lancer to burn off the adhered metal. Also, hangers solidified from the attached molten metal would extend between the mold and the mass moving away from the mold. Since this mass is still unsolidified in the center, the hangers would tear the solidified mass. In addition, the lubricant holes would become clogged, depriving the walls of the mold of lubricant. To protect the mold, a cover is provided. In accordance with the teachings of the prior art, this cover has an opening, aligned with the opening in the mold, whose inner and outer boundaries have sharp corners similar to the corners of the opening in the mold which the cover overlies.

In practice these prior-art covers proved unsatisfactory. There is splatter build-up on the cover from the molten metal. Hangers are still produced and they tear the skin of the molded metal resulting in break outs and costly damage. Frequently it is necessary to restart the continuous-casting line. Considerable time and cost for replacing molds and lancing is still demanded. The lubricant-injection holes still become clogged and the flow of lubricant is otherwise obstructed.

It is an object of this invention to overcome the above-described deficiencies of the prior art and to provide continuous-casting apparatus whose molds shall be effectively protected from molten metal which flows into the molds and the formation of hangers and the tearing of the skin of the molded metal together with the costs incident to the adhesion of metal from the molten mass shall be precluded. It is also an object of this invention to provide a cover for the mold of continuous-casting apparatus with which the above-described deficiencies of the prior art shall be overcome.

SUMMARY OF THE INVENTION

This invention arises from the realization that the difficulties and deficiencies of the prior art result partly from the tendency of metal, for example splatter, from the molten stream which passes through the mold to adhere to the sharp corners of the cover and to the cover itself and partly from the adhesion of metal and the formation of hangers at the discontinuities between the cover and the mold. It has also been realized that because the sharp corners of the cover nest in the corners of the mold, flow of lubricant is obstructed.

In accordance with this invention, the walls or edges which bound the opening in the cover are rounded to form a funnel-like rounded channel for the flow of the molten stream. The surfaces of the walls and the cover are highly finished to minimize adhesion of molten metal and are covered with an anti-friction, anti-adhesion coating which further reduces adhesion of spattered metal. The outer corners of the cover are also rounded providing an unobstructed and unobstructable channel, between the outer corners of the cover and the inner corners of the mold, for the flow of lubricant. The walls of the mold bounding its opening have a shoulder which has a fine finish and is as flat as practicable; that is, free of warps or burrs. The ends of the walls of the cover engaging this shoulder also have a fine finish and are as flat as practicable and free of warps or burrs so that the cover walls and the mold walls are mated providing no region where the formation of hangers may be started.

BRIEF DESCRIPTION OF THE DRAWINGS

For a better understanding of this invention, both as to its organization and as to its method of operation, together with additional objects and advantages thereof, reference is made to the following description taken in connection with the accompanying drawings in which:

FIG. 3 is an isometric view of a mold cover in accordance with this invention;

FIG. 4 is a plan view in the direction of arrow III of FIG. 3 of the cover shown in FIG. 3;

FIG. 4*a* is a view similar to FIG. 4 but showing dimensions of the cover;

FIG. 5 is a view in side elevation of the cover shown in FIG. 3;

FIG. 5*a* is a view similar to FIG. 5 but showing the dimensions of the cover;

FIG. 6 is a view in section taken along line VI—VI of FIG. 4 showing dimensions of the cover;

Dimensions are presented in FIGS. 4*a*, 5*a* and 6, not with any intention of in any way limiting this invention, but for the purpose of aiding those skilled in the art in practicing this invention.

DETAILED DESCRIPTION OF INVENTION

Figure 1:
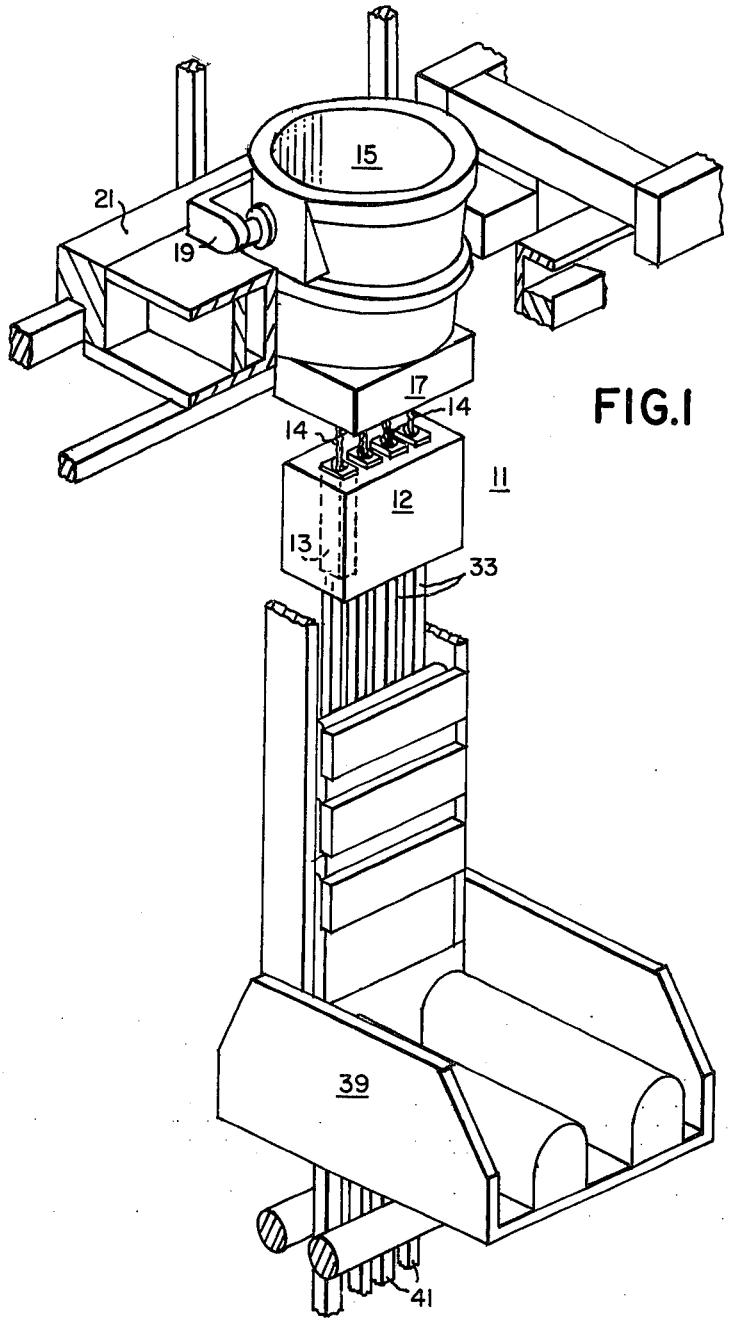
FIG. 1 is a view in perspective showing a continuous-casting apparatus in accordance with this invention.

FIG. 1 shows typical continuous-casting apparatus 11. This apparatus includes a mold unit 12 including a plurality of chill molds 13 (FIG. 2) into which a plurality of streams (lines) 14 of molten steel are poured from a ladle 15 through a tundish 17. The ladle 15 typically containing about 200 tons more or less of molten steel is delivered from the basic oxygen furnace shop to the casting apparatus 11. To maintain the casting line in continuous operation, one large ladle 15 or two ladles 15 in rotation are typically delivered. Each ladle 15 may be subjected to degassing by vacuum degassing units (not shown) and is then lifted by a hoist (not shown) onto a bracket 19 in a ladle-positioning car 21. The ladle 15 is positioned in the car 21 in pouring position over the tundish 17 which is also carried by the car 21 to the position over the mold unit 12. Where one ladle 15 is used the lines are usually started anew for each ladle; where two ladles in rotation are used the lines run continuously until the operation is stopped.

The mold unit 12 is a generally rectangular block, typically of steel, within which there are copper, water cooled molds 13. Each mold includes a cavity 115 (FIGS. 7, 8) which may have different forms. Typically, the cavity 115 has the form of a rectangular parallelepiped typically of square horizontal cross section as shown. The cavity 115 is defined by walls 117 which at the opening to the cavity 115 have shoulders 119 that are ground to fine finish and are burr free and warp free. The walls 117 are enclosed in a jacket 121 through which coolant flows. Near the top of the opening to the cavity 115, the jacket 121 and the walls 117 are penetrated by perforations 123 through which lubricant, typically rapeseed oil, is injected. At the start of a casting operation the cavity 115 is sealed at the bottom by a starter stool (not shown) which is engaged by a sealing mechanism (not shown). Coupling mechanisms not shown are sealed through the starter stool. Each mechanism not shown includes an attenuated member (not shown) which extends into the cavity 115 and serves as chill rod and a coupling member which extends from the starter stool and is grasped by a coupling device (not shown) and advanced to pinch rolls 39 which move the solidified steel strip 41 at the desired casting rate.

Figure 2:
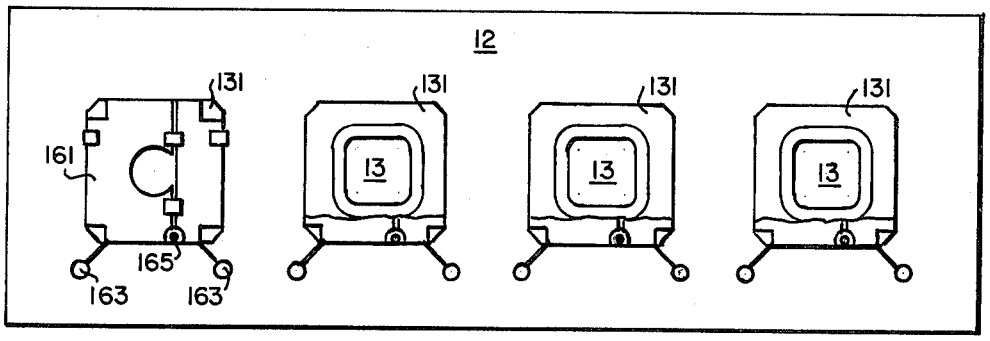
FIG. 2 is a plan view of the mold unit and its appurtenant parts with portions of the inert gas shroud supported on the mold cover broken away.
Figure 7:
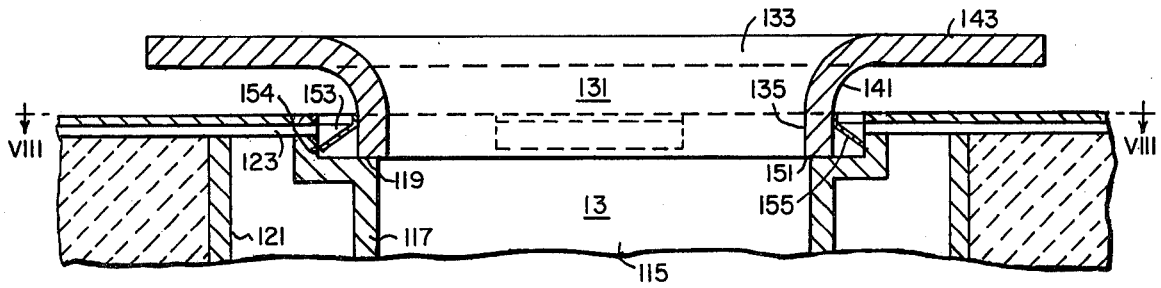
FIG. 7 is a view in longitudinal section of a mold in the apparatus shown in FIG. 1 with a cover in accordance with this invention.
Figure 8:
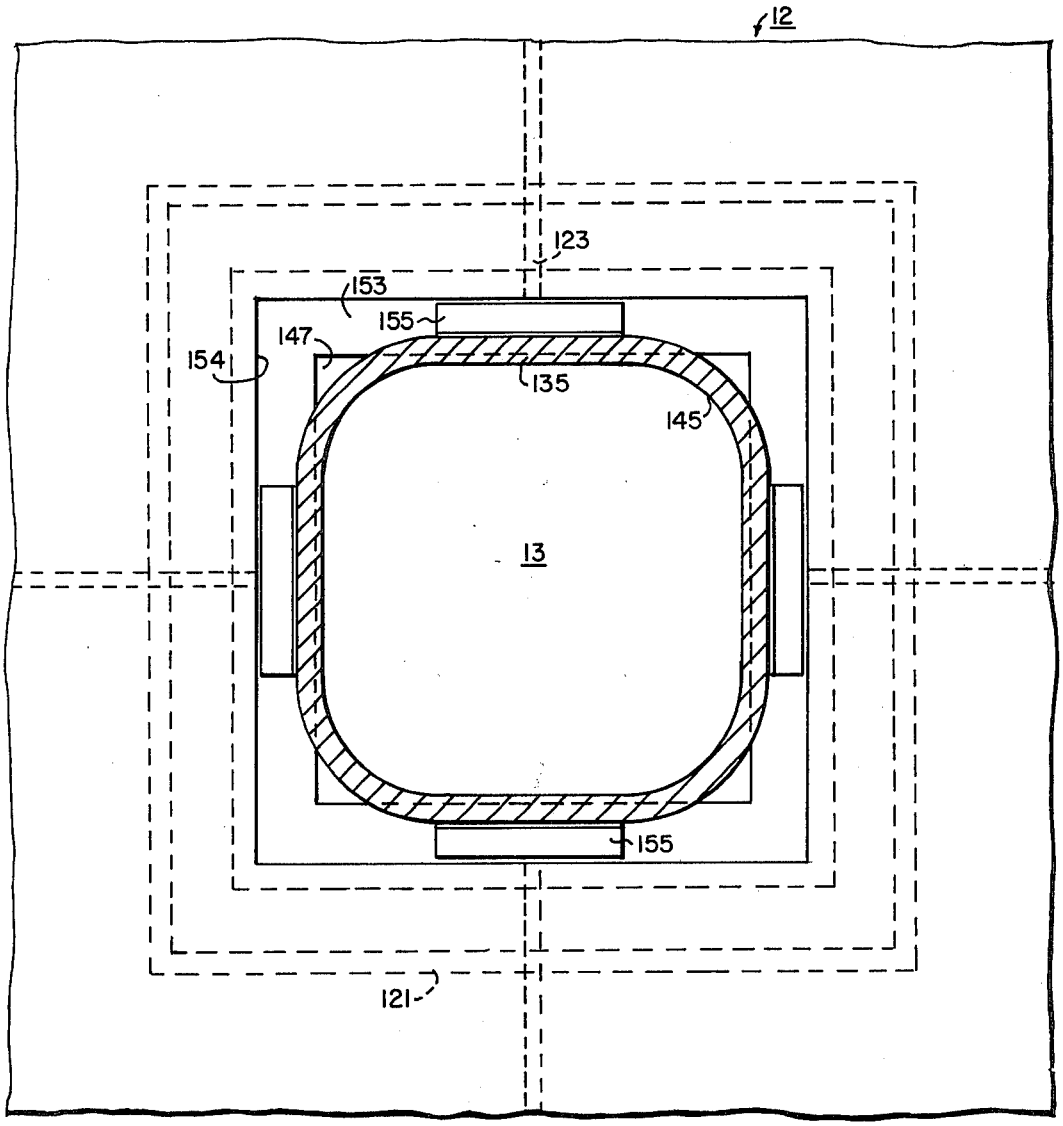
FIG. 8 is a view in section taken along line VIII—VIII of FIG. 7.

Each mold 13 has a cover 131 (FIGS. 2, 3, 4). The cover 131 (FIGS. 3–8) is of generally rectangular form having an opening 133 from whose boundary a stem 135 extends. The cover 131 is disposed over the mold 13 with the opening 133 coextensive with the opening in the mold 13 through which the stream 14 of metal flows into the cavity 115. The stem 135 rests on the shoulders 119 (FIG. 7).

The junction 141 formed of the edges between the top 143 of the cover and the stem 135 is rounded as are also the corners 145 (FIG. 8) of the stem 135. The opening 133 in the cover 131 thus has a funnel-shaped entrance. The corners of the mold 13 are sharp so that there is an elongated hole 147 (FIG. 8) of angular cross section between the outer walls of the stem 135 and the inner wall of the entrance to the cavity 115.

The ends 151 of the stem 115 also overlap the shoulders 119 by a small distance typically 1/16 inch. There is also a space 153 between the outer surface of the stem 135 and the inner surface of the portions 154 of the walls 117 which extend from the shoulder 119. To suppress undesired displacement of the cover 131 as the mold unit 12 vibrates, resilient spacer plates 155 are provided. These plates 155 are welded to the stem 135 and engage the wall of the portions 154. The holes 123 through which the lubricant is injected extend into these spaces 153.

Typically, the cover 131 is composed of A-36 hot-rolled steel. The cover 131 is fabricated as follows:

1. The hole 133 is formed from a blank by hydraulically deep-drawing the walls 135, and then the top 143, the total inner surfaces including the rounded junction 141, the top surface 143 and the ends 151 are given a fine finish by grinding with 500-mesh grit.

2. The cover derived from step 1 is heat treated as follows:

A. Heated to 1100° F and held for 20 minutes, then heated to 1550° F and held for 20 minutes ± 120 seconds.

B. Water quenched to 500° F and held for 3 minutes, then water quenched to 50° F by submerging in a water bath for intervals depending on the requirements of the apparatus in which it is to be installed.

3. The cover is machined so that it is free of warps and burrs, and is as flat as practicable.

4. The top 143 and the inner surface of the stem 135 are provided with a coating of liquid graphite 0.046 inch thick.

5. The bottom of plate 143 and the outer surface of the stem 135 is coated with 60-weight motor oil, typically to prevent rust. In lieu of the graphite coating, the top 143 and the inner surface of the stem 135 may be chromium plated to between 0.008 and 0.010 inch thick. However, chromium plating is costly and the graphite coating is preferred in the interest of economy.

The cover 131 formed and treated as outlined above is disposed with its ends 151 on the shoulder 119. The finished surfaces 151 and 119 are in complete surface engagement so that there are no crevices for the formation of hangers. The spacers 155 prevent movement of the cover 131 relative to the mold 13. The lubricant penetrates into the space 153. The joints between the ends 151 and the shoulders 119 prevent lubricant flow directly from the space 153 along the walls 117. However, the lubricant penetrates into the angular spaces 147 and thence flows along the walls 117 of the mold 13. The finished and coated surface 143 and inner surface of the stem 135 reflect the spatter from the molten streams 14 so that there is no build up of spatter or hangers.

Each cover 131 supports a shroud 161 (FIG. 2) through which inert gas, typically argon, is injected to shield the molten streams 14 as they pass from the tundish 17 through the mold 13. Each shroud 161 has the form of a truncated cone and is formed of two parts which may be pivoted by handles 163 about a pivot pin 165 which passes through the ends of the parts into a hole 167 in the cover 131. The cover 131 has holes 169 for pins (not shown) which lock the parts of the shroud to the cover.

While a preferred embodiment of this invention has been disclosed herein, many modifications thereof are feasible. This invention is not to be restricted except insofar as is necessitated by the spirit of the prior art.

I claim:

1. Continuous-casting apparatus including means to supply a stream of metal to be formed into slabs, billets or blooms, at least one mold aligned with said supply means and having an opening to receive said stream, said opening being bounded by walls extending along the direction of flow of said stream, a cover for said mold extending over said mold and having an opening aligned with said opening in said mold, said opening in said cover being bounded by walls extending in the direction of flow of said stream, said walls bounding the opening in said cover being rounded and the portions of said walls bounding said opening in said cover extending along the direction of flow of said stream overlying and mating with the walls bounding the opening in said mold, so as to suppress the adhesion of molten metal from said stream to the boundaries of the opening in said cover, said walls bounding the opening in said mold forming corners and the corresponding corners formed by the walls of the opening in said cover, which overlie the portions of said walls of the opening in said mold that form said corners of said opening in said mold, being rounded, providing generally angular opening through which lubricant may flow, between the corners formed by the walls bounding said opening in said mold and the outer surface of said walls bounding the opening in said cover.

2. Continuous-casting apparatus including means to supply a stream of metal to be formed into slabs, billets or blooms, at least one mold aligned with said supply means and having an opening of polygonal cross section to receive said stream, said opening being bounded by walls extending along the direction of flow of said stream, said walls forming sharp corners at their joints, a cover for said mold extending over said mold and having an opening aligned with said opening in said mold, said opening in said cover being of polygonal cross section the same as the polygonal cross section of said mold and being bounded by walls extending in the direction of flow of said stream, said walls of said cover being positioned in engagement with corresponding walls of said mold, said walls bounding the opening in said cover being rounded and the corners between said walls bounding the opening in said cover also being rounded, so that at the corners between the walls of said mold generally angular openings bounded by the walls of said mold and by the outer surfaces of the walls of said cover are formed, and the portions of said walls bounding said opening in said cover extending along the direction of flow of said stream overlying and mating with the walls bounding the opening in said mold, so as to suppress the adhesion of molten metal from said stream to the boundaries of the opening in said cover and boundaries of the opening in said mold at the mating surfaces between them.

3. Continuous-casting apparatus including means to supply a stream of metal to be formed into slabs, billets or blooms, at least one mold aligned with said supply means and having an opening to receive said stream, said opening being bounded by walls extending along the direction of flow of said stream, said walls having a continuous shoulder extending from said opening in said mold, the portions of said walls extending along the direction of flow of said stream being penetrated by holes through which lubricant is injected, and a cover for said mold extending over said mold and having an opening aligned with said opening in said mold, said opening in said cover being bounded by walls extending along the direction of flow of said stream, said walls bounding said opening in said cover being rounded and the portions of said walls bounding said opening in said cover, extending along the direction of flow of said stream, overlying and mating with the walls bounding the opening in said mold so as to suppress the adhesion of molten metal from said stream to the boundaries of the opening in said cover, the walls bounding the opening in said cover which extend along the direction of flow of said stream terminating in ends which engage and overhang said shoulder, the surface of said shoulder and the surface of said ends being finished so that said engaging surfaces form a joint substantially not penetrable by metal from said stream, the portions of the walls bounding the opening in said cover extending along the direction of flow of said stream being spaced from said portions of said walls bounding the opening in said mold thus providing a space therebetween permitting penetration of said lubricant, the corners bounding the opening in said mold and the outer surfaces of the walls bounding the opening in said cover defining between them a generally angular opening, said space communicating with the said generally angular opening to permit flow of said lubricant through said angular opening and along the portion of the walls of said mold which extend along the direction of flow of said stream.

* * * * *